US007328797B2

(12) United States Patent
Lin

(10) Patent No.: US 7,328,797 B2
(45) Date of Patent: Feb. 12, 2008

(54) TOOLBOX

(75) Inventor: Hung-Lin Lin, Changhua (TW)

(73) Assignee: Witman Corporation, Changhua (TW)

( * ) Notice: Subject to any disclaimer, the term of this patent is extended or adjusted under 35 U.S.C. 154(b) by 260 days.

(21) Appl. No.: 11/285,035

(22) Filed: Nov. 23, 2005

(65) Prior Publication Data

US 2007/0114150 A1 May 24, 2007

(51) Int. Cl.
*B65D 85/28* (2006.01)

(52) U.S. Cl. ..... 206/379; 206/372; 211/69

(58) Field of Classification Search ..... 206/349, 206/372, 373, 377, 378, 379, 743, 747, 748, 206/755; 211/69, 70.6; 312/902; 224/269
See application file for complete search history.

(56) References Cited

U.S. PATENT DOCUMENTS 3,074,539 A * 1/1963 Rogovin ..... 206/379
4,006,821 A * 2/1977 Sautter ..... 206/379
4,934,530 A * 6/1990 Riess ..... 206/379
5,813,533 A * 9/1998 Knoblauch ..... 206/379
6,547,074 B1 * 4/2003 Chen ..... 206/379
7,021,464 B2 * 4/2006 Chen ..... 206/379
7,188,726 B2 * 3/2007 Lin ..... 206/373
2006/0186007 A1 * 8/2006 Dost et al. ..... 206/379
2006/0226042 A1 * 10/2006 Seymour et al. ..... 206/379
2007/0090008 A1 * 4/2007 Chen ..... 206/372

* cited by examiner

*Primary Examiner*—David T. Fidei
(74) *Attorney, Agent, or Firm*—Rosenberg, Klein & Lee

(57) ABSTRACT

A toolbox, which includes a box body, a box cover pivotally connected to the box body with a shaft and two pivot bolts, and a plurality of tool holders coupled to one another and pivotally supported on the shaft and turnable with the box cover out of the box body one after another into a spread-out status like the action of a fan when opening the box cover from the box body.

2 Claims, 4 Drawing Sheets

TOOLBOX

BACKGROUND OF THE INVENTION

1. Field of the Invention

The present invention relates to a toolbox for holding tools/tool bits and more particularly, to such a toolbox, which comprises a plurality of tool holders that are turned out of the box body and spread out like a fan when opening the box cover from the box body.

2. Description of the Related Art

Conventional toolboxes for holding saw blades or cutters are commonly made having a box body and a box cover for covering the box body. The box body defines therein a plurality of compartments for holding saw blades and cutters. These conventional toolboxes do not provide much storage space for holding a number of saw blades and/or cutters. Further, when picking up the storage saw blades or cutters, the user may be injured by the cutting edges of the storage saw blades or cutters accidentally.

SUMMARY OF THE INVENTION

The present invention has been accomplished under the circumstances in view. It is the main object of the present invention to provide a toolbox, which enables the user to pick up the storage tools/tool bits conveniently and safely. To achieve this and other objects of the present invention, the toolbox comprises box body, a box cover pivotally connected to the box body with a shaft and two pivot bolts, and a plurality of tool holders coupled to one another and pivotally supported on the shaft. The tool holders each have a pin at one side and an arched coupling groove at the other side. The pin of one tool holder is coupled to the arched coupling groove of another tool holder. When opening the box cover from the box body, a part of the box cover is forced to hook on the pin of one tool holder to further turn the tool holders one after another about the shaft, and therefore the tool holders are turned out of the box body and spread out like a fan.

DETAILED DESCRIPTION OF THE PREFERRED EMBODIMENT

Figure 1A:
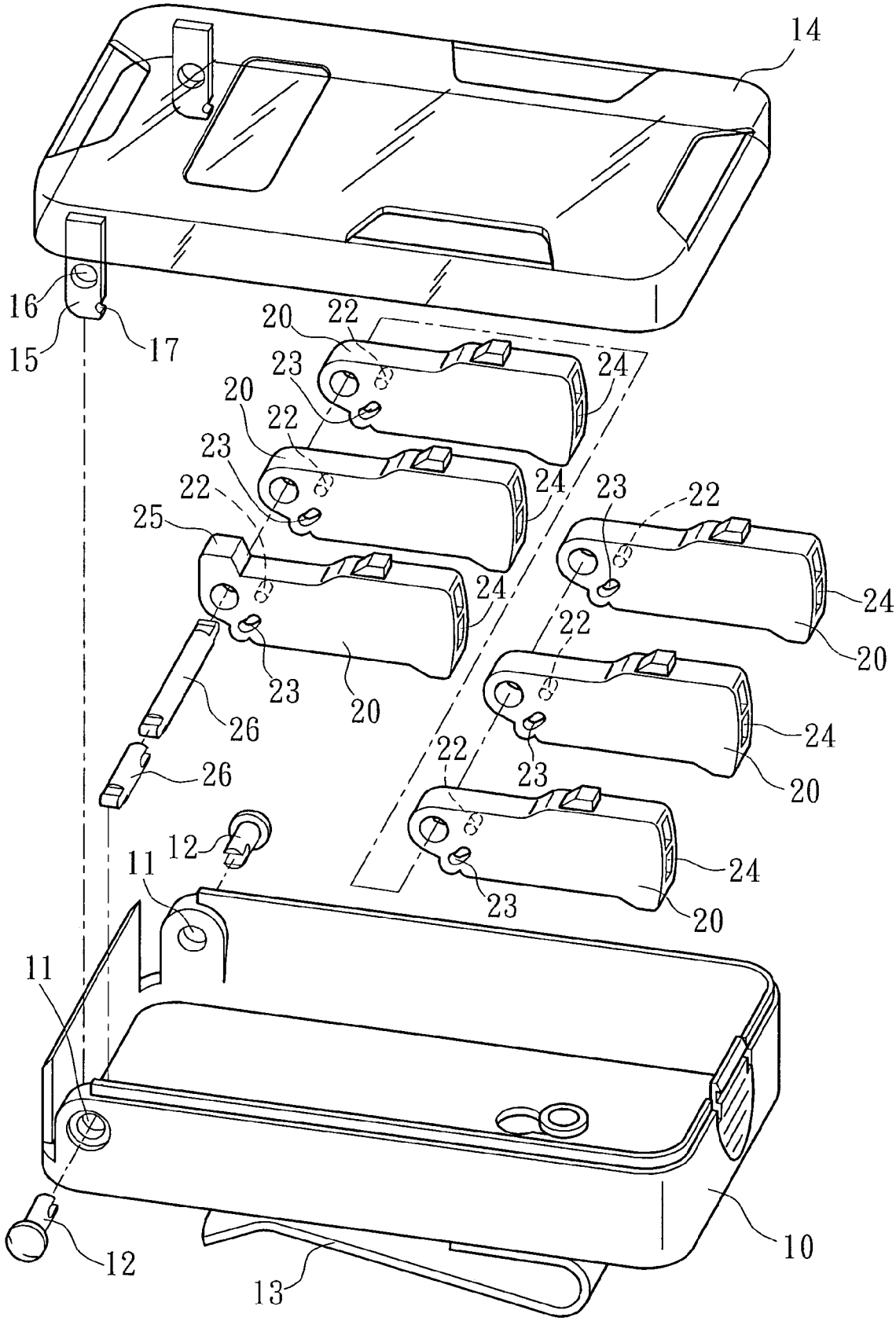
FIG. 1A is an exploded view of a toolbox according to the present invention.
Figure 1B:
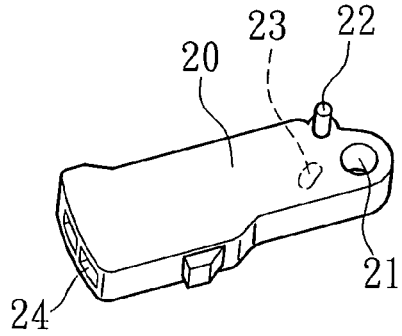
FIG. 1B is a perspective view of one tool holder of the toolbox according to the present invention.

Referring to FIGS. 1~5, a toolbox in accordance with the present invention is shown comprising a box body 10, a box cover 14, and a plurality of tool holders 20.

The box body 10 has a clip 13 provided at the back side for fastening to the user's body belt, and two pivot holes 11 aligned at two opposite lateral sides near one end.

The box cover 14 fits over the top open side of the box body 10, having two bottom lugs 15 bilaterally disposed near one end. The bottom lugs 15 each have a pivot hole 16 corresponding to the pivot holes 11 at the box body 10, and a retaining notch 17.

The tool holders 20 are hollow flat blocks, each having a plurality of tool holes 24 for holding tools, for example, saw blades 27, a pivot hole 21 disposed at one end, a pin 22 disposed at one side near the pivot hole 21 (see FIG. 1B), and an arched coupling groove 23 disposed at the opposite side.

Further, a shaft 26 is inserted through the pivot holes 21 of the tool holders 20 to secure the tool holders 20 together, keeping the pin 22 of one tool holder 20 coupled to the arched coupling groove 23 of another tool holder 20, and then two pivot bolts 12 are respectively mounted in the pivot holes 11 of the box body 10 and the pivot holes 16 of the bottom lugs 15 of the box cover 14 and connected to the two distal ends of the shaft 26 to pivotally secure the shaft 26 and the tool holders 20 to the inside of the box body 10.

According to the present invention, the parts of the toolbox are respectively injection-molded from plastics for the advantage of low manufacturing cost.

Figure 2:
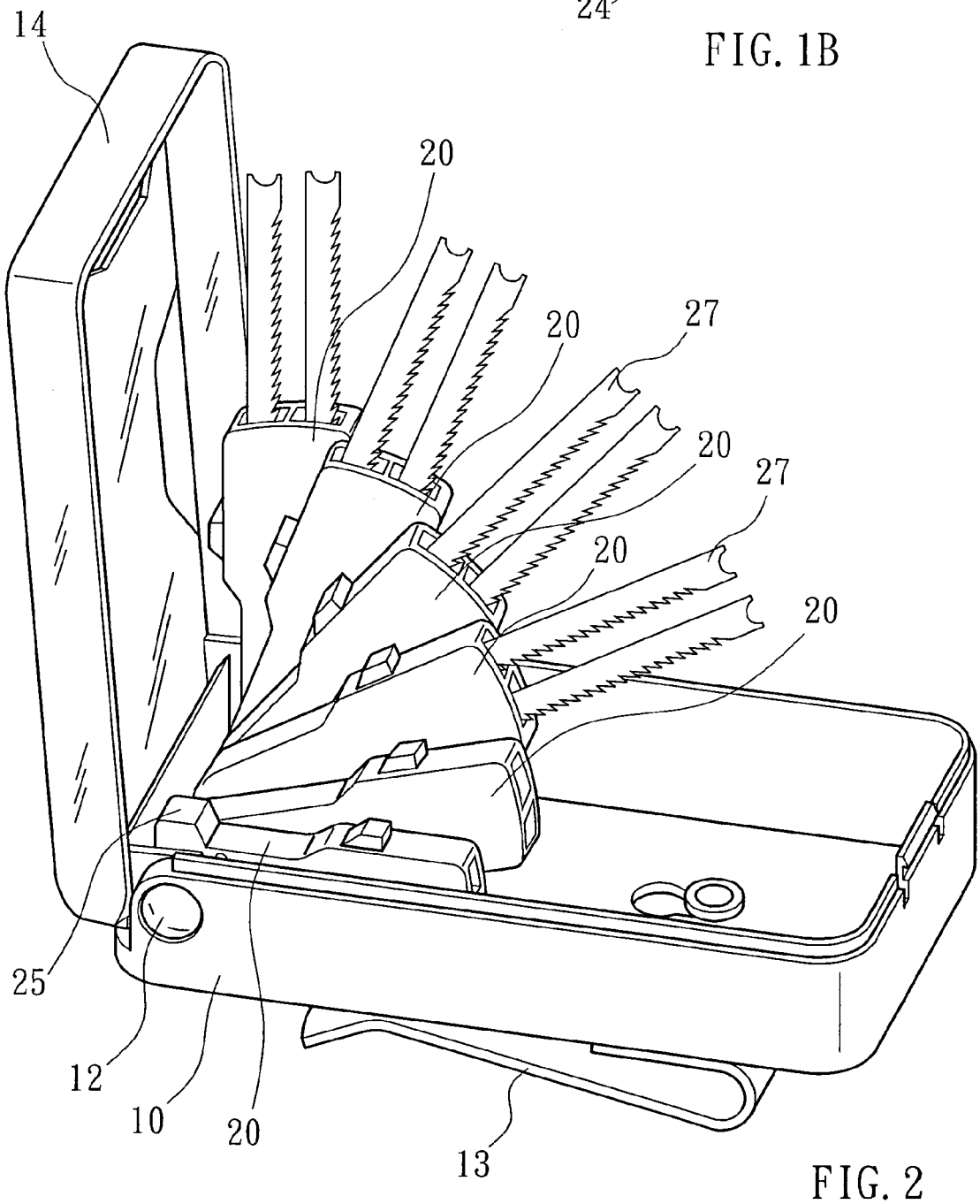
FIG. 2 is an elevational view of the present invention, showing the toolbox opened, the tool holders turned out of the box body and spread out.
Figure 3:
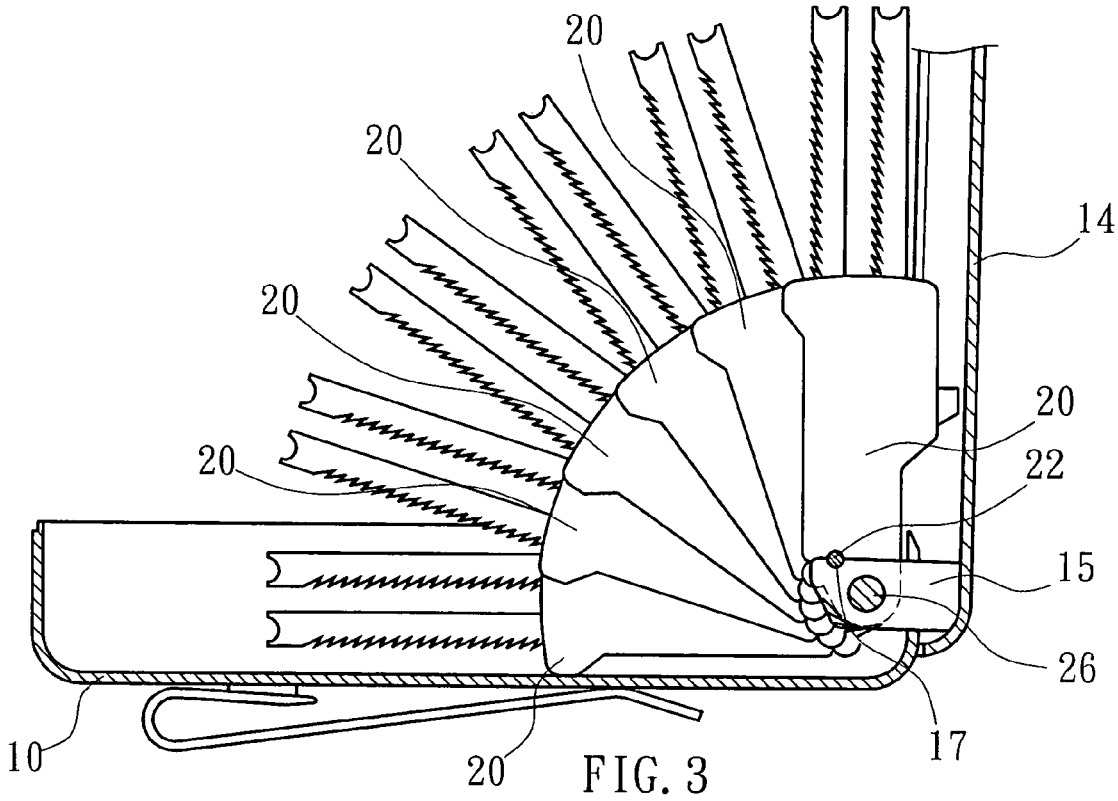
FIG. 3 is a schematic side plain view of the present invention, showing the toolbox opened, the tool holders turned out of the box body and spread out.
Figure 4:
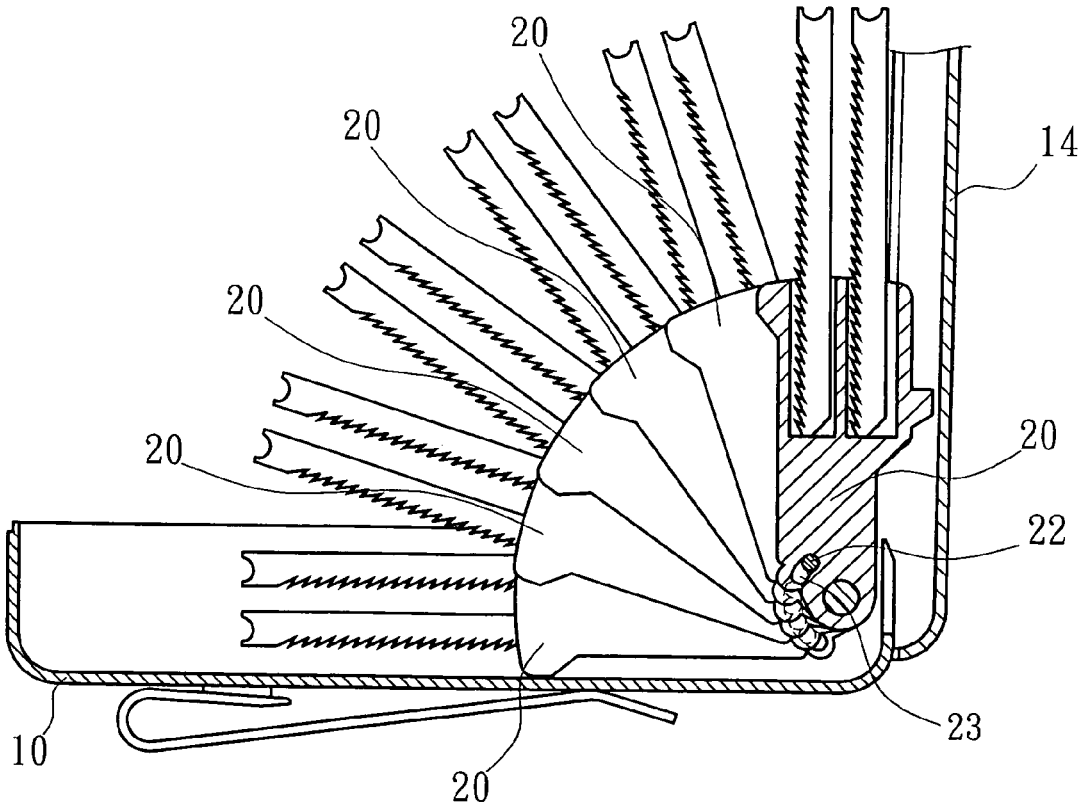
FIG. 4 is a sectional side view of the present invention, showing the toolbox opened, the tool holders turned out of the box body and spread out, the pin of each tool holder stopped at one end of the arched coupling groove of the adjacent tool holder.

Referring to FIGS. 2~4 again, when opening the box cover 14 from the box body 10, the retaining notch 17 of one bottom lug 15 is forced to hook on the pin 12 of the adjacent tool holder 20 and to further turn the respective tool holder 20 about the shaft 26, and the other tool holders 20 and turned one after another about the shaft 26 due to the linking effect between the respective pins 22 and the respective arched coupling grooves 23. When the box cover 14 is fully opened, the tool holders 20 and turned out of the box body 10 and spread out like a fan. Further, one of the tool holders 20 has a protruding block 25, which is stopped against the inside wall of the box body 10 to limit the turning angle of the tool holders 20 when the box cover 14 is fully opened.

Figure 5:
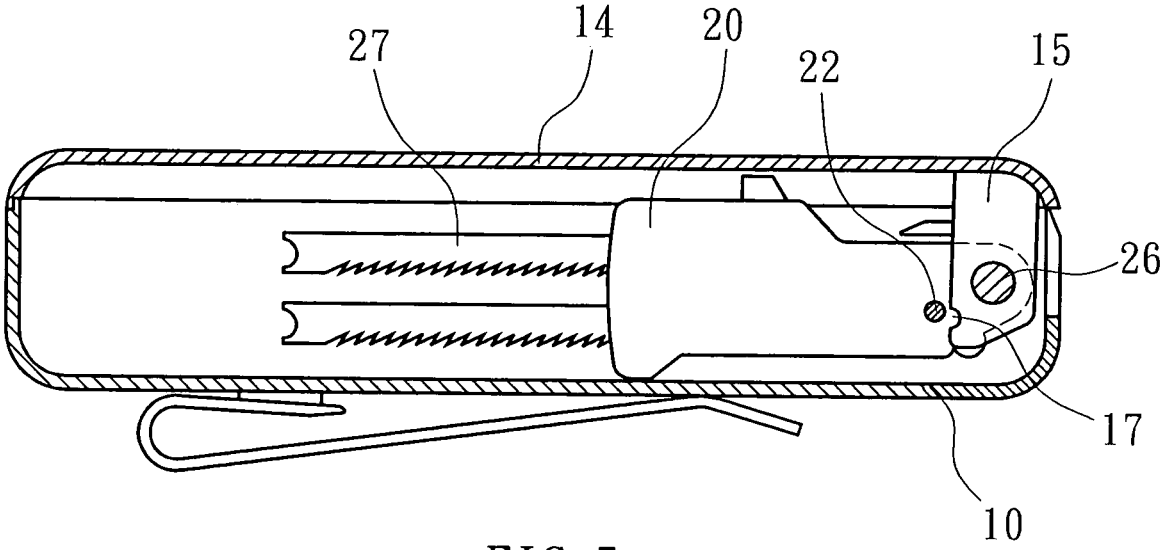
FIG. 5 is a sectional side view showing the received status of the toolbox according to the present invention.

Referring to FIG. 5, when the box cover 14 is closed on the box body 10, the tool holders 20 are disengaged from the retaining notches 17 of the bottom lugs 15 of the box cover 14 and turned one after another about the shaft 26 in the reversed direction and received with the storage tools (saw blades) 27 inside the box body 10.

Figure 6:
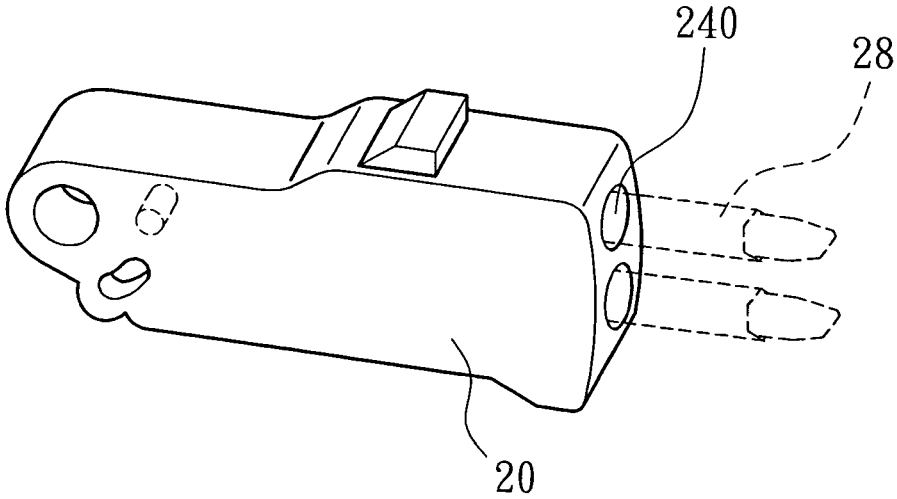
FIG. 6 illustrates an alternate form of the tool holder for the toolbox according to the present invention.

FIG. 6 shows an alternate form of the present invention. According to this embodiment, each tool holder 20 has tool bit holes 240 for holding tool bits 28.

Although a particular embodiment of the invention has been described in detail for purposes of illustration, various modifications and enhancements may be made without departing from the spirit and scope of the invention.

What the invention claimed is:

1. A toolbox comprising:

a box body, said box body having a clip provided at a back side thereof for fastening, and two pivot holes aligned at two opposite lateral sides of one end thereof;

a box cover for covering said box body, said box cover having two bottom lugs bilaterally disposed near one end thereof, said bottom lugs each having a pivot hole corresponding to the pivot holes at said box body and a retaining notch;

a plurality of tool holders, said tool holders each having a plurality of accommodating holes for holding tools and tool bits, a pivot hole disposed at one end thereof, a pin disposed at one side thereof near the respective pivot hole, and an arched coupling groove disposed an opposite side thereof, the pin of one of said tool holders being coupled to the arched coupling groove of another of said tool holders;

a shaft inserted through the pivot holes of said tool holders to secure said tool holders together for enabling said tool holders to be spread out like a fan; and two pivot bolts respectively mounted in the pivot holes of said box body and the pivot holes of the bottom lugs of said box cover and connected to two distal ends of said shaft to pivotally secure said shaft and said tool holders to the inside of said box body for enabling the retaining notch of one of said bottom lugs of said box cover to hook on the pin of one of said tool holders and to further turn said tool holders out of said box body about said shaft one after another when opening said box cover from said box body.

2. The toolbox as claimed in claim 1, wherein one of said tool holders has a protruding block for stopping against an inside wall of said box boxy to limit the turning angle of said tool holders about said shaft when opening said box cover from said box body.

* * * * *